US005766742A

United States Patent [19]

Nakamura et al.

[11] Patent Number: 5,766,742

[45] Date of Patent: Jun. 16, 1998

[54] CUTTING BLADE MADE OF TITANIUM CARBONITRIDE-BASE CERMET, AND CUTTING BLADE MADE OF COATED CERMET

[75] Inventors: Seiichiro Nakamura; Takafumi Fujisawa; Kiyohiro Teruuti; Hisafumi Tsujisaki; Masanao Nonaka, all of Ishige-machi, Japan

[73] Assignee: Mitsubishi Materials Corporation, Tokyo, Japan

[21] Appl. No.: 741,904

[22] Filed: Oct. 31, 1996

[30] Foreign Application Priority Data

| | | | |
|---|---|---|---|
| Jul. 18, 1996 | [JP] | Japan | 8-189184 |
| Oct. 7, 1996 | [JP] | Japan | 8-266017 |
| Oct. 7, 1996 | [JP] | Japan | 8-266018 |

[51] Int. Cl.[6] ..... B23B 27/14

[52] U.S. Cl. ..... 428/210; 428/325; 428/212; 428/336; 428/217; 428/697; 428/698; 428/699; 428/704; 428/457; 428/469; 51/307; 51/309; 407/119

[58] Field of Search ..... 428/210, 212, 428/217, 336, 325, 697, 698, 699, 704, 457, 469; 51/309, 307; 407/119

[56] References Cited

U.S. PATENT DOCUMENTS

| | | | |
|---|---|---|---|
| 3,684,497 | 8/1972 | Wendler et al. . | |
| 4,778,521 | 10/1988 | Iyori et al. . | |
| 4,902,395 | 2/1990 | Yoshimura . | |
| 4,957,548 | 9/1990 | Shima et al. | 75/241 |
| 5,110,543 | 5/1992 | Odani et al. . | |
| 5,296,016 | 3/1994 | Yoshimura et al. . | |
| 5,370,719 | 12/1994 | Teruuchi et al. . | |
| 5,374,471 | 12/1994 | Yoshimura et al. . | |
| 5,436,071 | 7/1995 | Odani et al. . | |
| 5,460,893 | 10/1995 | Teruuchi et al. . | |
| 5,462,524 | 10/1995 | Daring et al. | 75/239 |
| 5,518,822 | 5/1996 | Teruuchi et al. . | |

OTHER PUBLICATIONS

Japanese Laid-Open Patent Publication No. 8-300204.

(List continued on next page.)

*Primary Examiner*—Archene Turner

*Attorney, Agent, or Firm*—Oblon, Spivak, McClelland, Maier & Neustadt, P.C.

[57] ABSTRACT

In a cutting blade made of a titanium carbonitride-base cermet comprising:

3 to 20% by weight of a metal binder phase, the principal ingredients of which are Co and/or Ni, 3 to 30% by weight of a single-structural hard phase comprising at least one component selected from the group consisting of carbide, nitride and carbonitride compounds of metal elements belonging to Groups 4*a*, 5*a* and 6*a* of the periodic table and a solid-solution comprising at least two said compounds, and the balance being a double-structural hard phase which comprises a core portion and a shell portion completely surrounding said core portion, wherein said core and shell portions comprise as substituents titanium carbonitride and/or a carbonitride compound of Ti and at least one element M selected from metal elements belonging to Groups 4*a*, 5*a* and 6*a* of the periodic table other than Ti, except that the shell portion must contain a carbonitride compound of at least M, and wherein said shell portion has a lower content of Ti and a higher content of M than those in the core portion, respectively; and incidental impurities, the improvement comprising:

said double-structural hard phase is partly or wholly substituted with a discontinuous double-structural hard phase comprising a core portion and a shell portion, in which the shell portion is discontinuously distributed around the core portion so that the core portion is partially exposed to the metal binder phase, and said discontinuous double-structural hard phase occupies 30 or more area % of the total surface of the cermet in terms of electron-microscopic texture analysis and whereby the cutting blades exhibit excellent fracture-resistance.

16 Claims, 2 Drawing Sheets

OTHER PUBLICATIONS

Japanese Publication No. 4–55801 (application No. 63–285215): Application Priority Document of U.S. Patent N. 5.110.543.

Japanese Publication No. 7–45707 (application of No. 61–280268): Application Priority Document of U.S. Patent No. 4.902.395.

Japanese Laid–Open Publication No. 3–226576 (application No. 2–21048): Application Priority Document of U.S. Patent No. 5.436.071.

Japanese Laid–Open Publication No. 6–49646 (application No. 4–227874): Application Priority Document of U.S. Patent No. 5.436.071.

Japanese Laid–Open Publication No. 6–57429 (application No. 4–235265): Application Priority Document of U.S. Patent No. 5.436.071.

Japanese Laid–Open Publication No. 6–57430 (application No. 4–227866): Application Priority Document of U.S. Patent No. 5.436.071.

Japanese Laid–Open Publication No. 6–57431 (application No. 4–227867): Application Priority Document of U.S. Patent No. 5.436.071.

Japanese Laid–Open Publication No. 4–341580 (application No. 2–418976): Application Priority Document of U.S. Patent No. 5.296.016.

No. HE107–132860 (Publication No. HE108–300204).

CUTTING BLADE MADE OF TITANIUM CARBONITRIDE-BASE CERMET, AND CUTTING BLADE MADE OF COATED CERMET

BACKGROUND OF THE INVENTION

1. Field of the Invention

The present invention relates to cutting blades made of cermet (cermet cutting blades), and more particularly, relates to a cutting blade made of a titanium carbonitride-base cermet which exhibits excellent fracture resistance.

2. Description of the Related Art

In the early period after cermet cutting blades had been developed, TiC—Mo—Ni alloys were used as cermets. Such alloys were, however, remarkably inferior to cemented carbide in toughness though they were highly wear-resistant. This limited the use of the cermet cutting blades to high-speed-finish-cutting of steels. After that, the addition of a nitride compound such as TiN was found to be considerably effective in improving the toughness of cermets. The cutting blades made of such cermets, therefore, have been used for milling, which is substantially interrupted cutting, in addition to being used for turning of steels, with utilizing the advantages inherent in cermet, namely, high wear-resistance and capability of providing high-quality surface finish for products. Meanwhile, in cutting blades made of cemented carbide, coated carbide was developed. The coated carbide comprise a base material of a cemented carbide, and a coat of a hard compound such as TiC, Ti(C,N), $Al_2O_3$ or the like provided on the surface of the base material. Such coated carbides exhibit improved wear-resistance without losing the toughness as the original characteristic of cemented carbide. Under such circumstances, cermet has been required to be further improved in toughness without losing its high wear-resistance.

In general, cermets have hard phases having a core/shell (or core/rim) structure in which a grain of Ti(C,N) or the like is surrounded with a carbonitride solid solution such as (Ti,Mo) (C,N). Noting this feature inherent in cermet, many investigations were made to improve the toughness of cermet. For example, the specification of U.S. Pat. No. 4,778,521 discloses a core/shell structure comprising three layers, namely, a core of Ti(C,N), a WC-rich intermediate layer surrounding the core, and an outer layer of (Ti,W) (C,N) surrounding the intermediate layer. Further, EP Publication No. 0,406,201 B1 discloses a cermet having two or more types of core/shell structures for its hard phases. Additionally, EP Publication No. 0,578,031 A2 discloses a cermet comprising a matrix of the conventional core/shell structure, and Ti-rich hard phases dispersed in the matrix.

Though some improvement has been accomplished, these cermets remain unsatisfactory in toughness since they are based on the conventional cermet structure which comprises a core of hard Ti compound grains or hard Ti-rich compound grains and a shell of a carbonitride solid solution surrounding the grains. An attempt to further enhance the toughness of such a cermet requires an increased content of a binder metal such as cobalt or nickel. This causes some problems, for example, decreased wear resistance and decreased plastic-deformation resistance.

Further, a characteristic of Ti, which is a principal ingredient of the hard phases in cermet, to easily react with nitrogen is utilized for producing highly wear-resistant cermet. Specifically, a hard layer hardened region can be formed on the surface of cermet by controlling the partial pressure of nitrogen in the sintering atmosphere. Actually, Japanese Laid-open Patent Publication No. 2-15139 discloses a cermet wherein wear resistance in the surface portion of the cermet is enhanced by using a technique like the above. Although this cermet is highly wear-resistant, it also remains to be improved in toughness since the texture of the cermet also comprises the core/shell structure as described above.

SUMMARY OF THE INVENTION

The present invention has been accomplished to solve the above-described problems, and an aspect of the present invention is as follows.

In a cutting blade made of a titanium carbonitride-base cermet comprising:

3 to 20% by weight of a metal binder phase, the principal ingredients of which are Co and/or Ni, 3 to 30% by weight of a single-structural hard phase comprising at least one component selected from the group consisting of carbide, nitride and carbonitride compounds of metal elements belonging to Groups 4*a*, 5*a* and 6*a* of the periodic table and a solid-solution comprising at least two said compounds, and the balance being a double-structural hard phase which comprises a core portion and a shell portion completely surrounding said core portion, wherein said core and shell portions comprise as substituents titanium carbonitride and/or a carbonitride compound of Ti and at least one element M selected from metal elements belonging to Groups 4*a*, 5*a* and 6*a* of the periodic table other than Ti, except that the shell portion must contain a carbonitride compound of at least M, and wherein said shell portion has a lower content of Ti and a higher content of M than those in the core portion, respectively; and incidental impurities, the improvement comprising:

said double-structural hard phase is partly or wholly substituted with a discontinuous double-structural hard phase comprising a core portion and a shell portion, in which the shell portion is discontinuously distributed around the core portion so that the core portion is partially exposed to the metal binder phase, and said discontinuous double-structural hard phase occupies 30 or more area % of the total surface of the cermet in terms of electron-microscopic texture analysis, and whereby the cutting blade exhibits excellent fracture-resistance.

Further, another aspect of the present invention is a cutting blade made of a coated cermet based on the above-described cermet, wherein the cermet is coated with at least one compound selected from titanium carbide, titanium nitride, titanium carbonitride, titanium carbonate-nitride, (Ti,Al)N, and aluminum oxide in a thickness of 0.5 to 20 μm.

In the cermet cutting blade or coated cermet cutting blade of the present invention recited above, a hardened region may be present in their surface portion, wherein the peak of Vickers hardness higher than the Vickers hardness of the inner portion is present within a range from the top surface of the blade to 50 μm under the top surface.

Additionally, in the cermet cutting blade or coated cermet cutting blade of the present invention recited above, the mean grain sizes of the hard phases are preferably 0.1 to 1.5 μm, respectively, and more preferably, 0.5 to 1.2 μm, respectively.

Further, in the coated cermet cutting blade of the present invention recited above, the coating may contain a (Ti,Al)N coating layer having a thickness of 0.5 to 5 μm and being provided by a PVD method; or may contain a TiCN coating layer having a thickness of 0.5 to 5 μm and being provided by a MT-CVD method so that the grain of TiCN grows as longitudinal crystals in the direction perpendicular to the surface of the cermet.

DESCRIPTION OF THE PREFERRED EMBODIMENT

Figure 2:
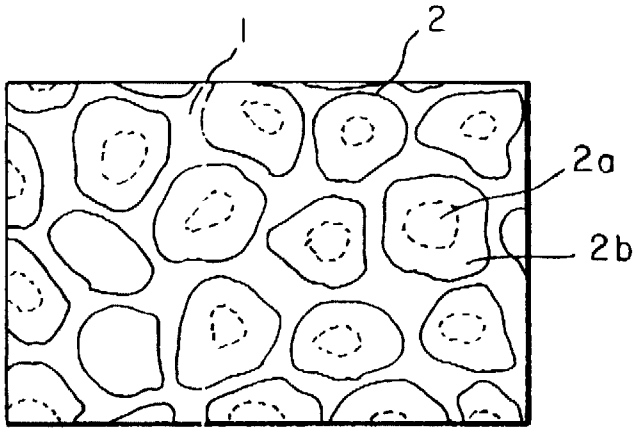
FIGS. 2 and 4 are similar but are of cermet cutting blades not according to the claimed invention.

The inventors investigated improving the toughness of cermet to be used for cutting blades, noting the core/shell structure employed in the prior inventions.

In general, cermets contain Ti compounds for improving wear resistance. The Ti compounds are present in cermets principally as cores in hard phases, namely, as cores of Ti(C,N) or Ti-rich carbonitride solid solution grains, and each core is surrounded with a shell, namely, other carbonitride solid solution grains which contain lower contents of Ti than the former grains. Though both crystal structures of the core grains and shell grains are of an NaCl type, these grains are different in the coefficient of thermal expansion due to the difference in the ingredient composition. Accordingly, there is a thermal stress between the core and the shell which is caused by such difference. Since the mode of the thermal stress varies depending on the ingredient contents of the core and the rim, it cannot be uniformly determined which of the core and the shell is affected by tensile stress, or how strong the stress is. Nevertheless, the core, which contains a larger amount of Ti, seems to be much more affected by tensile stress than the rim, which contains relatively large amounts of W and Mo. The grains having a NaCl type crystal structure, such as the core and the shell above, do not exhibit slide deformation while the grains having a WC type crystal structure do. The phases constituted with the former grains are, therefore, brittle and easily broken by tensile stress. Consequently, decreasing the thermal stress in the core/shell structure is recognized as important for improving the toughness of cermet. In Japanese Laid-open Patent Publication No. 6-248385, there is disclosed a cermet containing the phases of Ti(C,N) grains which have a single structure, namely, which have a non-core/shell structure. In this cermet, however, the content of such phases is as low as 1 through 5% by volume, and most of the phases constituting the cermet are of the ordinary core/shell structure type. The thermal stress is, therefore, not sufficiently decreased in this cermet. Further, even if the content of the single-structural phases of the Ti(C,N) grains can be raised, the portion comprising such grains will be low in hardness, and the wear resistance will decrease since the binding strength between the Ti(C,N) grains and the metal binder phases is small.

Under such circumstances, the inventors reached an idea as follows: Thermal stress inherent in the ordinary core/shell structure may be decreased by making the core/shell structure incomplete, namely, by allowing the hard grains of Ti(C,N) or of a Ti-rich complex-metal carbonitride compound (these grains correspond to the core of the ordinary core/shell structure) to be in the state of mutually contacting with grains which have relatively low Ti contents (these grains correspond to the shell of the ordinary core/shell structure); or by allowing the hard grains of Ti(C,N) or of a Ti-rich complex-metal carbonitride compound to be in the state of being incompletely surrounded with grains which have relatively low Ti contents, wherein a part of the former grain is exposed. In other words, the inventors conceived of a structure for cermet in which a part of the core is exposed to the metal binder phases, and the shell is discontinuously distributed around the core.

Such a structure could be actually accomplished as follows. At first, Ti(C,N) powder produced directly from a titanium oxide compound was selected as a raw material. Then, in the process of sintering the mixed powder of raw materials, the sintering was stopped before a core/shell structure could sufficiently be developed. On a cermet thus obtained, a cutting test was performed and revealed that the cermet having such a structure has, along with the above anticipation, both high wear resistance and high toughness.

The present invention has been accomplished according to the above findings. Typically, the cermet of the present invention comprises metal binder phases, single-structural hard phases, double-structural hard phases each of which comprise a core portion and a shell portion completely surrounding the core portion, and double-structural hard phases each of which comprise a core portion and a shell portion discontinuously distributed around the core portion.

As principal ingredients of the metal binder phases in cermets, Co and/or Ni are ordinarily used. With a content of these elements below 3% by weight, the cermet will be brittle due to too a small amount of metal binding phases which supports the toughness of the cermet. On the other hand, with a content exceeding 20% by weight, the cermet will be low in hardness and cannot be applied to cutting blades. For these reasons, the content of Co and/or Ni has been determined to be 3 to 20% by weight in the cermet of the present invention.

Further, the content of metal carbonitride compounds, which constitute the single-structural hard phases in the cermet of the present invention, has been specified to be 3 to 30% by weight. With a content below 3% by weight, the desired improving effect in wear resistance cannot be achieved. On the other hand, with a content exceeding 30% by weight, fracture resistance of the cermet will deteriorate.

Among the double-structural hard phases in the cermet of the present invention, the double-structural hard phases in which the shell portion is discontinuously distributed around the core portion has been specified to occupy 30 area % or more of the total surface of the cermet. With a ratio below 30 area %, sufficient effect of decreasing thermal stress inherent in the core/shell structure cannot be achieved. When such a cermet is used for a cutting blade, the phases in the composition will be crushed during the cutting procedure. In other words, fracture resistance of the cermet cannot be markedly improved with such a ratio.

As described above, by controlling the sintering atmosphere, the cermet can be produced so that the portions near the surface of the composition have small amounts of metal binder phases while having large amounts of hard phases. According to this, a cutting blade can be provided with a hardened region at its surface portion, and the wear resistance of the blade can be improved. Here, the cermet cutting blade can possess much higher toughness as well as high wear resistance by providing, using the cermet of the present invention as the base, such hardened regions at the top surface portion of the blade. Such cermet cutting blades were actually manufactured and a cross section of each cutting blade was examined for hardness using a micro Vickers hardness meter. As a result, a hardness gradient was observed in the cross section of each cutting blade. The hardness gradient started at a point 0.5 to 1 mm under the surface, and ascended substantially continuously toward the surface. In each cutting blade, the peak of the hardness value, which was higher than those of the inner portions of the cutting blade, was measured within a range from the top surface to 50 μm under the top surface, but were not measured in further deeper portions. According to this, in the cermet cutting blade of the present invention, the peak of Vickers hardness could be specified to be present at a position within a range from the top surface to 50 μm under the top surface. As to the ratio of the peak hardness value to the hardness value of the inner portion, a desired wear resistance cannot be fully achieved with a ratio below 1.3, and the surface of the cutting blade becomes too hard and tends to be easily broken with a ratio exceeding 1.8. Accordingly, the ratio of peak hardness value to hardness value of the inner portion should preferably be 1.3 to 1.8 in the cutting blade of the present invention.

Depending on the conditions for manufacturing, the top surface of the cutting blade may be provided also with softened regions which comprise bonding phases alone or comprise metal binding phases and hard phases merely having a single structure, and which have lower hardness values than those of the inner portions. Such softened regions may coexist with the above-described hardened regions at the top surface of the cermet cutting blade of the present invention.

Frequently, cermets are used as a base for cutting blades which should be manufactured by coating the base with a titanium carbide, a titanium nitride, a titanium carbonitride, and a titanium carbonate-nitride (hereinafter, these are referred to as Ti-compounds), (Ti,Al)N, aluminum oxide and/or the like by a CVD method or a PVD method. Here, the effect attributed to coating will be further enhanced by using the cermet of the present invention as the base, which has high toughness and excellent wear resistance.

The thickness of the coating layer provided on the surface of a cermet base material should preferably be 0.5 to 20 μm.

In the PVD methods, the depositing rate is relatively slow, and the resultant coating layer will easily cause spalling due to compressive residual stress in the coating when the coating is too thick. For these reasons, the thickness of the coat formed by the PVD method should be 0.5 to 15 μm, and preferably, 1 to 10 μm.

Since the (Ti,Al)N coat formed by the PVD method is highly thermally conductive, markedly improved thermal-shock resistance will be achieved particularly in the products in which the cermet of the present invention having high toughness and excellent wear resistance is used as a substrate and a (Ti,Al)N coat is provided on the surface of the substrate.

In coating a substrate of the cermet with Ti-compounds or aluminum oxide by a CVD method, when the substrate is coated at a high temperature (i.e. using a HT-CVD method) with TiC or Ti(C,N) which has high wettability with the ingredients of the metal binder phases in the cermet, the ingredients of the metal binder phases, especially Ni, will be dispersed into the coat to decrease wear resistance of the coated product. For this reason, when a CVD method is employed, a substrate of the cermet should be coated preferably at a low temperature, namely, by using a MT-CVD method which can coat the substrate with Ti(C,N) at 1000° C. or below. This inhibits the dispersion of ingredients of the metal binder phases into the coating layer. Alternatively, the following coating process may be employed: At first, a coat with TiN, which has low wettability with the ingredients of the metal binder phases, is formed by a HT-CVD method; on the coat thus formed, a Ti(C,N) coat is formed by a MT-CVD method; and further, a coat with aluminum oxide or the like is formed thereon.

A Ti(C,N) coating layer to be formed by a MT-CVD method can be a thick layer, by allowing to grow as longitudinal crystals in the direction perpendicular to the surface of the substrate, without decreasing the strength of the cutting edge of the cutting blade to be produced therewith. This remarkably improves wear resistance of products. The effect attributed to such coating will be enhanced particularly by using, as the substrate, the cermet of the present invention which has high toughness and excellent wear resistance.

Additionally, the compounds such as (Ti,Al)N which are rarely applicable to CVD methods can be introduced into a cermet as a coating layer by employing a PVD method in combination. Specifically, a core with a coating material is first formed by a CVD method, and a coat with (Ti,Al)N or the like is formed on the first formed coat by a PVD method.

In the cermet cutting blade and coated cermet cutting blade according to the present invention, the cermet as the substrate is a titanium carbonitride-base cermet principally comprising titanium, and all of the hard phases in the composition have a crystal structure of NaCl type.

In general, the hard phases which are constituted principally with titanium are hard and brittle, and are easily broken by concentration of stress when the grain sizes of hard phases exceed 1.5 μm. On the other hand, when the grain sizes are smaller than 0.1 μm, wear resistance of the hard phases become lower and craters due to wear easily become larger, and in addition, plastic deformation will easily occur. For these reasons, the grain sizes of the hard phases should be 0.1 to 1.5 μm, and preferably, 0.5 to 1.2 μm according to the present invention.

As to metal elements other than titanium, M, which belongs to Group 4a, 5a or 6a of the periodic table, when the content of M exceeds 50% by weight, the relative content of Ti will be low, and therefore, wear resistance of a cermet to be produced will decrease since Ti is an effective ingredient for raising hardness of cermets. For this reason, the content of M should be 50% or less by weight.

The content of nitrogen in a titanium carbonitride-base cermet increases the amount of M present in the metal binder phases as solid-solution to solid-solution-harden the bonding phases. In addition, the nitrogen improves the toughness of hard phases and inhibits the granular growth of the grains in hard phases during the sintering process. The content of nitrogen calculated from the formula expressed in terms of moles, N/(C+N), should preferably be 0.1 to 0.6. When the content expressed by the above formula is below 0.1, the desired effect as above cannot be achieved. On the other hand, when the content expressed by the above formula exceeds 0.6, the degree of sintering will decrease and pores will frequently remain in the cermet.

EXAMPLE 1

Cermet cutting blades according to the present invention, EX 1 to EX 10, and cermet cutting blades for comparison, CE 1 to CE 10, were respectively manufactured as follows.

As raw materials, the powders listed below were prepared. Each powder had a predetermined mean particle size within a range of 0.5 to 2 μm.

Ti(C,N) powder (C/N=50/50 by weight), TiN powder,

TaC powder, NbC powder, WC powder, $Mo_2C$ powder, VC powder, ZrC powder, $Cr_3C_2$ powder, (Ti,W,Mo) (C,N) powder (Ti/W/Mo=70/20/10, C/N=70/30), (Ti,Ta,V) (C,N) powder (Ti/Ta/V=70/20/10, C/N=60/40), (Ti,Nb,Mo) (C,N) powder (Ti/Nb/Mo=80/10/10, C/N=50/50), Co powder, Ni powder, and graphite powder C.

These powders were mixed so as to have the formulations shown in Table 1, respectively, and each mixture was wet-blended for 24 hours and dried. The resultant formulations were pressed into shapes with a pressure of 1 t/cm$^2$ to obtain green compacts A to J.

TABLE 1

| Green | Formulation (% by weight) | | | | | | | | | |
|---|---|---|---|---|---|---|---|---|---|---|
| Compact | Ti (C,N) | TiN | TaC | NbC | WC | $Mo_2C$ | Co | Ni | C | Other |
| A | 55 | 10 | 5 | 10 | 5 | 10 | 2 | 1 | 2 | |
| B | 15 | | 13 | 16 | | | 1 | 3 | 2 | (Ti,W,Mo) (C,N):50 |
| C | 60 | 5 | | 6 | 12 | 8 | 2 | 5 | 2 | |
| D | 65 | | 7 | | 7 | 7 | 3 | 6 | 2 | ZrC:3 |
| E | 35 | 14 | | 6 | 8 | 6 | 3 | 7 | 1 | (Ti,Ta,V) (C,N):20 |
| F | 55 | | 10 | 8 | | 11 | 7 | 3 | 1 | $Cr_3C_2$:5 |
| G | 50 | 8 | 2 | 6 | 5 | 16 | 6 | 6 | 1 | |
| H | 45 | 10 | 10 | | 5 | 5 | 7 | 7 | 1 | (Ti,Nb,Mo) (C,N):10 |
| I | 50 | | 10 | 14 | 10 | | 8 | 7 | 1 | |
| J | 45 | 14 | | 5 | 10 | 5 | 12 | 8 | 1 | |

Each of the above-prepared green compacts A to J was sintered using the following sintering conditions: At first, in a vacuum atmosphere of 0.05 torr, the sintering temperature was raised from room temperature to 1300° C. at a rate of 2° C./min.; the atmosphere was then changed to a nitrogen atmosphere of 10 torr or below, and the sintering temperature was raised to a predetermined temperature within a range of 1380° C. to 1460° C. at the same temperature-ascending rate; after the sintering temperature reached the predetermined temperature, the atmosphere was changed to a vacuum atmosphere of a predetermined pressure within a range of 0.5 to 30 torr, and the state was retained for 60 min.; and furnace cooling was performed in the same atmosphere. According to the above sintering procedure, ten cermet cutting blades of the present invention, EX 1 to EX 10, were manufactured. Each cermet cutting blade had cutting inserts having ISO Standards of CNMG120408.

For comparison, another set of the green compacts A to J were prepared and sintered using the same procedure as above, except that the sintering temperature was raised to a higher predetermined temperature within a range of 1530° C. to 1560° C., to obtain ten cermet cutting blades for comparison, CE 1 to CE 10.

Subsequently, a cross section of each cermet cutting blade was examined for Vickers hardness successively from the top surface to an inner portion of the blade in order to determine the depth where the peak of the Vickers hardness was present Further, an inner position in the cross section of the blade was properly selected and the texture around this position was observed by an electron microscope, and the formation and percentage of hard phases in the texture were analyzed by an image analysis system.

Additionally, the mean grain size of the hard phases was also measured by an image analysis.

Figure 1:
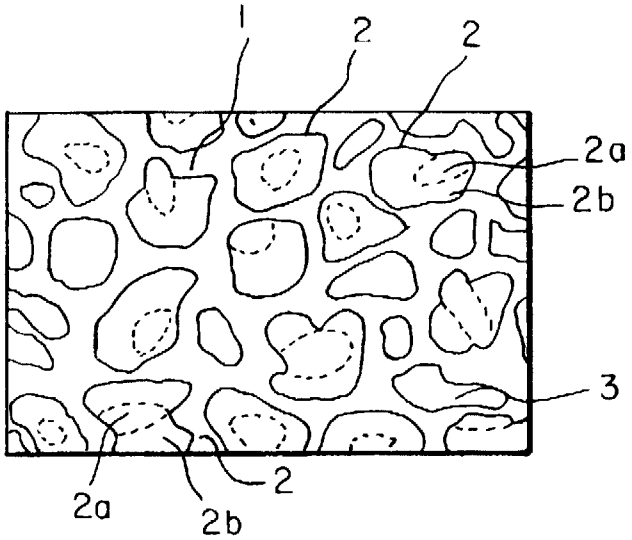
FIGS. 1 and 3 are schematic drawings showing internal textures of the cermet cutting blades according to the claimed invention, observed by the electron microscope.

FIGS. 1 and 2 are schematic drawings showing internal textures of the cermet cutting blades EX 7 and CE 7, respectively, observed by the electron microscope.

In these schematic drawings, indications of the numerals are as follows.

The numeral 1 indicates metal binder phases principally constituted with Co and/or Ni.

The numeral 2 indicates hard phases having a double structure. In detail, the numeral **2*a* indicates core portions comprising a carbonitride compound and/or a titanium carbonitride, the carbonitride compound comprising Ti and at least one element M selected from metal elements belonging to Groups 4*a*, 5*a* and Ga of the periodic table other than Ti. On the other hand, the numeral 2*b*** indicates shell portions comprising a (Ti,M)-carbonitride compound while the content of Ti is smaller and that of M is larger than in the core portions.

The numeral 3 indicates hard phases having a single structure which comprise at least one compound which is selected from carbide, nitride or carbonitride compounds of metal elements belonging to Group **4*a*, 5*a* or 6*a*** of the periodic table; and a solid-solution constituted with at least two of these compounds.

Further, the fracture resistance of each cermet cutting blade manufactured as described above was evaluated by measuring the flank-wear breadth of the cutting edge after wet interrupted-cutting was performed under the following conditions.

Steel material to be cut: a round bar standardized as JIS S20C, DIN CK22, ANSI 1020, which has four flutes provided in the longitudinal direction at regular intervals;

Cutting speed: 250 m/min.;

Feed rate: 0.2 mm/rev.;

Depth of cut: 2 mm; and

Cutting time: 20 min.

The results are shown in Tables 2 and 3.

TABLE 2

| Cement Cutting blade of the Present Invention | Green Compact | Hardness of Surface Portion (HV) | Hardness of Inner Portion (HV) | Area Percentage (%) of Hard Phases: Total | Single Sturctural | Double Structural: Having Completely Surrounding Surface Portion | Double Structural: Having Discontinuously Distributed Surface Portion | Mean Grain Size of Hard Phases (μm) | Flank-Wear Breadth (mm) |
|---|---|---|---|---|---|---|---|---|---|
| EX 1 | A | 2020 | 2020 | 95 | 8 | 32 | 55 | 0.9 | 0.09 |
| EX 2 | B | 1920 | 1930 | 95 | 3 | 31 | 61 | 1.3 | 0.09 |
| EX 3 | C | 1970 | 1980 | 94 | 10 | 53 | 31 | 0.5 | 0.13 |
| EX 4 | D | 1900 | 1880 | 93 | 6 | 12 | 75 | 1.5 | 0.15 |
| EX 5 | E | 1860 | 1850 | 92 | 4 | 21 | 67 | 1.2 | 0.18 |
| EX 6 | F | 1850 | 1850 | 89 | 3 | 49 | 37 | 0.9 | 0.17 |
| EX 7 | G | 1700 | 1720 | 89 | 14 | 45 | 44 | 0.8 | 0.21 |
| EX 8 | H | 1650 | 1660 | 87 | 3 | 27 | 57 | 0.6 | 0.24 |
| EX 9 | I | 1600 | 1610 | 89 | 9 | 30 | 50 | 1.2 | 0.24 |
| EX 10 | J | 1530 | 1530 | 85 | 22 | 0 | 63 | 1.0 | 0.27 |

TABLE 3

| Cement Cutting blade of the Present Invention | Green Compact | Hardness of Surface Portion (HV) | Hardness of Inner Portion (HV) | Area Percentage (%) of Hard Phases: Total | Single Sturctural | Double Structural: Having Completely Surrounding Surface Portion | Double Structural: Having Discontinuously Distributed Surface Portion | Mean Grain Size of Hard Phases (μm) | Flank-Wear Breadth (mm) |
|---|---|---|---|---|---|---|---|---|---|
| CE 1 | A | 2030 | 2000 | 95 | 2 | 93 | — | 1.8 | *(2 min.) |
| CE 2 | B | 1930 | 1940 | 95 | 2 | 93 | — | 1.7 | *(2 min.) |
| CE 3 | C | 1960 | 1950 | 95 | 0 | 95 | — | 1.4 | *(5 min.) |
| CE 4 | D | 1890 | 1890 | 92 | 1 | 91 | — | 1.2 | *(5 min.) |
| CE 5 | E | 1870 | 1870 | 90 | 0 | 90 | — | 1.5 | *(8 min.) |
| CE 6 | F | 1870 | 1850 | 88 | 0 | 88 | — | 1.4 | **(10 min.) |
| CE 7 | G | 1690 | 1700 | 89 | 1 | 88 | — | 2.0 | *(8 min.) |
| CE 8 | H | 1610 | 1630 | 88 | 2 | 86 | — | 2.2 | *(15 min.) |
| CE 9 | I | 1620 | 1610 | 88 | 0 | 88 | — | 1.8 | *(10 min.) |
| CE 10 | J | 1530 | 1530 | 85 | 2 | 83 | — | 1.7 | **(15 min.) |

*Blade inoperable by the time shown in the parentheses due to breakage.
**Blade inoperable by the time shown in the parentheses due to chipping From the results of the above image analyses, all of the cermet cutting blades of the present invention, EX 1 to EX 10, were found to contain 30 area % or more of double-structural hard phases, the shell portion of which is discontinuously distributed around the core portion. On the other hand, all of the cermet cutting blades for comparison, namely, conventional cermet cutting blades, CE 1 to CE 10, were found to comprise double-structural hard phases, the shell portion of which is completely distributed around the core portion, namely, completely surrounding the core portion; and/or single-structural hard phases.

As is obvious from the results shown in Tables 2 and 3, the cermet cutting blades of the present invention are provided with much more excellent fracture-resistance as compared to the conventional cermet cutting blades.

EXAMPLE 2

Another set of the green compacts A to J were prepared, and some of these green compacts were sintered under the following conditions to manufacture six cermet cutting blades of the present invention, EX 11 to EX 16: At first, in a vacuum atmosphere of 0.05 torr, the sintering temperature was raised from room temperature to 1300° C. at a rate of 2° C./min.; the atmosphere was then changed to a nitrogen atmosphere of 5 torr, and the sintering temperature was raised to a predetermined temperature within a range of 1400° C. to 1460° C. at the same temperature-ascending rate; after the sintering temperature reached the predetermined temperature, the atmosphere was changed to a vacuum atmosphere of a predetermined pressure within a range of 0.01 to 0.1 torr, and the state was retained for 60 min.; and furnace cooling was performed in the same atmosphere. Each cermet cutting blade thus obtained had cutting inserts having ISO Standards of CNMG120408.

For comparison, another set of the green compacts A to J were prepared and some of these green compacts were sintered using the same procedure as above, except that the sintering temperature was raised to a higher predetermined temperature within a range of 1530° C. to 1560° C. and that the atmosphere for the sintering step at this temperature is a nitrogen atmosphere of a predetermined pressure within a range of 5 to 15 torr, to obtain six cermet cutting blades for comparison, CE 11 to CE 16.

Subsequently, a cross section of each cermet cutting blade was examined for Vickers hardness successively from the top surface to an inner portion of the blade in order to determine the depth where the peak of hardness was present.

Further, an inner position in the cross section of the blade was properly selected and the texture around this position was observed by an electron microscope, and the formation and percentage of hard phases in the texture was analyzed by an image analysis system.

Additionally, the mean grain size of hard phases was also measured by an image analysis.

Figure 4:
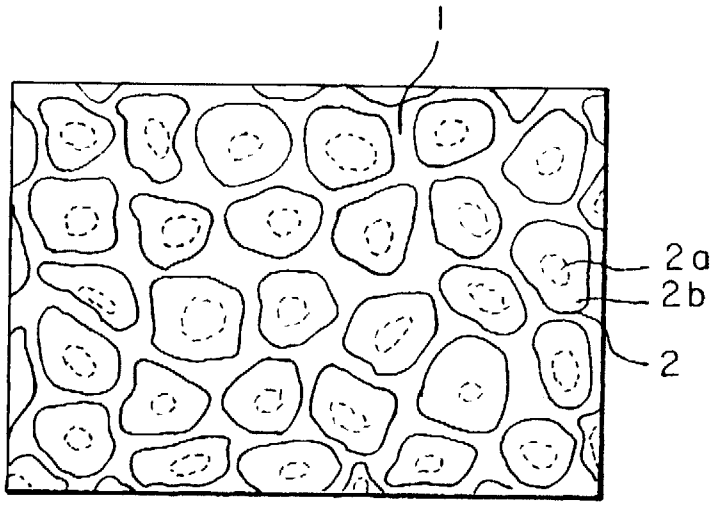
Figure 3:
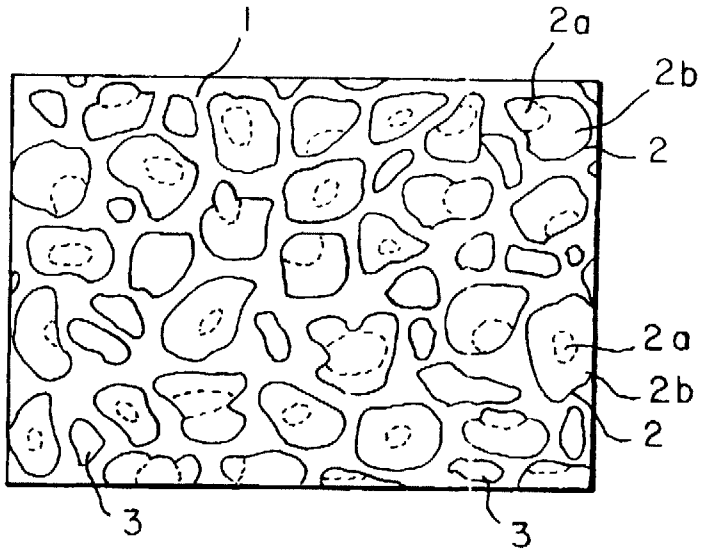

FIGS. 3 and 4 are schematic drawings showing internal textures of the cermet cutting blades EX 14 and CE 14 observed by the electron microscope, respectively.

Further, the fracture resistance of each cermet cutting blade manufactured as described above was evaluated by measuring the flank-wear breadth of the cutting edge after wet interrupted-cutting was performed under the following conditions.

Steel material to be cut: a round bar standardized as JIS S20C, DIN CK22, ANSI 1020, which has four flutes provided in the longitudinal direction at regular intervals;

Cutting speed: 300 m/min.;

Feed rate: 0.2 mm/rev.;

Depth of cut: 2 mm; and

Cutting time: 20 min.

The results are shown in Tables 4 and 5.

From the results of the above image analyses, all of the cermet cutting blades of the present invention, EX 11 to EX 16, were found to have a hardened region in the surface portion, and contain 30 area % or more of double-structural hard phases, the shell portion of which is discontinuously distributed around the core portion. On the other hand, all of the cermet cutting blades for comparison, namely, conventional cermet cutting blades, CE 11 to CE 16, were found to comprise double-structural hard phases, the shell portion of which is completely distributed around the core portion, namely, completely surrounding the core portion; and/or single-structural hard phases.

As is obvious from the results shown in Tables 4 and 5, the cermet cutting blades of the present invention are provided with much more excellent fracture-resistance as compared to the conventional cermet cutting blades.

EXAMPLE 3

Another set of the cermet cutting blades EX 1 to EX 10 according to the present invention were manufactured, and some of these were used as substrates and coated by the methods shown in Table 6 to obtain coated cermet cutting blades of the present invention, EXc 1 to EXc 12, each cutting blade having the coating formulation and the mean layer thickness shown in Table 6.

TABLE 4

| Cement Cutting blade of the Present Invention | Green Compact | Hardness of Surface Portion (HV) | Peak of Hardness Depth (μm) | Peak of Hardness Hardness (HV) | Hardness of Inner Portion (HV) | Area Percentage (%) of Hard Phases: Total | Single Structural | Double Structural: Having Completely Surrounding Surface Portion | Double Structural: Having Discontinuously Distributed Surface Portion | Mean Grain Size of Hard Phases (μm) | Flank-Wear Breadth (mm) |
|---|---|---|---|---|---|---|---|---|---|---|---|
| EX 11 | A | 2500 | 10 | 2930 | 2010 | 96 | 5 | 23 | 68 | 0.8 | 0.06 |
| EX 12 | C | 1820 | 25 | 2860 | 2100 | 94 | 8 | 54 | 32 | 1.2 | 0.12 |
| EX 13 | D | 2610 | 0 | 2610 | 1820 | 92 | 12 | 0 | 60 | 1.4 | 0.14 |
| EX 14 | G | 1370 | 50 | 2390 | 1500 | 66 | 24 | 23 | 39 | 0.8 | 0.19 |
| EX 15 | I | 1760 | 10 | 2020 | 1430 | 65 | 9 | 27 | 49 | 0.6 | 0.25 |
| EX 16 | J | 1810 | 15 | 1980 | 1320 | 81 | 30 | 0 | 51 | 0.7 | 0.24 |

TABLE 5

| Cement Cutting blade of the Present Invention | Green Compact | Hardness of Surface Portion (HV) | Peak of Hardness Depth (μm) | Peak of Hardness Hardness (HV) | Hardness of Inner Portion (HV) | Area Percentage (%) of Hard Phases: Total | Single Structural | Double Structural: Having Completely Surrounding Surface Portion | Double Structural: Having Discontinuously Distributed Surface Portion | Mean Grain Size of Hard Phases (μm) | Flank-Wear Breadth (mm) |
|---|---|---|---|---|---|---|---|---|---|---|---|
| CE 11 | A | 2800 | 15 | 2960 | 2000 | 96 | 1 | 95 | — | 1.8 | *(1 min) |
| CE 12 | C | 2790 | 5 | 2810 | 1940 | 93 | 0 | 93 | — | 1.7 | *(3 min) |
| CE 13 | D | 2210 | 10 | 2600 | 1860 | 93 | 1 | 92 | — | 1.5 | *(5 min) |
| CE 14 | G | 1960 | 0 | 1960 | 1620 | 87 | 2 | 85 | — | 1.3 | *(7 min) |
| CE 15 | I | 1830 | 15 | 1920 | 1510 | 85 | 0 | 8S | — | 1.3 | **(16 min) |
| CE 16 | J | 1790 | 10 | 1890 | 1390 | 80 | 1 | 79 | — | 1.2 | **(18 min) |

*Blade inoperable by the time shown in the parentheses due to breakage.

**Blade inoperable by the time shown in the parentheses due to chipping.

The coating conditions were as follows when an arc ion plating system, which is a system for physical vapor deposition, was used.

Raw materials: Ti, Ti—Al target, and reactor gas ($CH_4$ and $N_2$)

Coating temperature: 700° C.

Coating pressure: $2\times10^{-2}$ Torr

Bias voltage: −200 V

When a chemical vapor deposition system was used, the coating conditions were as follows.

Coating material: reactor gas ($TiCl_4$, $CH_4$, $N_2$ and $H_2$; When TiCN should be deposited, $CH_3CN$ was used instead of $CH_4$.)

Coating temperature: 1010° C.; 890° C. when TiCN should be deposited.

Coating pressure: 100 Torr; 50 Torr when TiCN should be deposited.

For comparison, another set of the cermet cutting blades for comparison, CE 1 to CE 10, were manufactured, and some of these were subjected to the same procedure as above to manufacture coated cermet cutting blades for comparison, CEc 1 to CEc 12.

On each cermet cutting blade manufactured as described above, the fracture resistance was evaluated by measuring the flank-wear breadth of the cutting edge after wet interrupted-cutting was performed under the following conditions.

Steel material to be cut: a round bar standardized as JIS S20C, DIN CK22, ANSI 1020, which has four flutes provided in the longitudinal direction at regular intervals;

Cutting speed: 350 m/min.;

Feed rate: 0.2 mm/rev.;

Depth of cut: 2 mm; and

Cutting time: 20 min.

The results are shown in Table 6.

TABLE 6

| | | Base | | Formulation of Hard Coating Layers and Mean Thickness Thereof (μm) ←(Lower Layer)(Upper Layer)→ | Coating Method | Flank-Wear Breadth (mm) |
|---|---|---|---|---|---|---|
| Coated Cerment Cutting Blade of the Present Invention | EXc 13 | Coated Cerment Cutting Blade of the Present Invention | EX 1 | TiN[0.5]-Ti(C,N)[3]-TiN[0.5] | PVD | 0.14 |
| | EXc 14 | | EX 3 | (Ti,Al)N[3]-TiN[0.2] | PVD | 0.11 |
| | EXc 15 | | EX 4 | TiN[2]-(Ti,Al)N[6] | PVD | 0.14 |
| | EXc 16 | | EX 7 | TiN[1]-(Ti,Al)N[4]-TiN[0.5] | PVD | 0.15 |
| | EXc 17 | | EX 9 | Ti(C,N)[1]-(Ti,Al)N[6] | PVD | 0.16 |
| | EXc 18 | | EX 10 | TiN[0.5]-Ti(C,N)[1]-(Ti,Al)N[2]-TiN[0.2] | PVD | 0.19 |
| | EXc 19 | | EX 1 | Ti(C,N)[5]-TiN[1] | CVD | 0.11 |
| | EXc 20 | | EX 3 | TiN[0.5]-Ti(C,N)[4]-$Al_2O_3$[1]-TiN[0.5] | CVD | 0.09 |
| | ExC 21 | | EX 4 | Ti(C,N)[5]-Ti(C,O) [0.5]-$Al_2O_3$[5] | CVD | 0.11 |
| | EXc 22 | | EX 7 | TiN[1]-Ti(C,N) [3]-TiN[1] | CVD | 0.17 |
| | EXc 23 | | EX 9 | TiN[0.5]-Ti(C,N) [5]-TiC[2]-$Al_2O_3$[2]-TiN[0.5] | CVD | 0.16 |
| | ExC 24 | | EX 10 | TiN[0.5]-TiCN[0.5]-Ti(C,N,O)[1]-$Al_2O_3$[5]-TiN[0.5] | CVD | 0.16 |
| Coated Cerment Cutting Blade for Comparison | CEc 13 | Coated Cerment Cutting Blade for Comparison | CE 1 | TiN[0.5]-Ti(C,N)[3]-TiN[0.5] | PVD | *(1 min) |
| | CEc 14 | | CE 3 | (Ti,Al)N[3]-TiN[0.2] | PVD | *(3 min) |
| | CEc 15 | | CE 4 | TiN[2]-(Ti,Al)N[6] | PVD | *(5 min) |
| | CEc 16 | | CE 7 | TiN[1]-(Ti,Al)N[4]-TiN[0.5] | PVD | *(9 min) |
| | CEc 17 | | CE 9 | Ti(C,N)[1]-(Ti,Al)N[6] | PVD | *(7 min) |
| | CEc 18 | | CE 10 | TiN[0.5]-Ti(C,N)[1]-(Ti,Al)N[2]-TiN[0.2] | PVD | **(10 min) |
| | CEc 19 | | CE 1 | Ti(C,N)[5]-TiN[1] | CVD | *(2 min) |
| | CEc 20 | | CE 3 | TiN[0.5]-Ti(C,N)[4]-$Al_2O_3$[1]-TiN[0.5] | CVD | *(2 min) |
| | CEc 21 | | CE 4 | Ti(C,N)[5]-Ti(C,O)[0.5]-$Al_2O_3$[5] | CVD | *(4 min) |
| | CEc 22 | | CE 7 | TiN[1]-Ti(C,N)[3]-TiN[1] | CVD | *(5 min) |
| | CEc 23 | | CE 9 | TiN[0.5]-Ti(C,N)[5]-TiC[2]-$Al_2O_3$[2]-TiN[0.5] | CVD | *(6 min) |
| | CEc 24 | | CE 10 | TiN[0.5]-TiCN[0.5]-Ti(C,N,O)[1]-$Al_2O_3$[5]-TiN[0.5] | CVD | *(6 min) |

*Blade inoperable by the time shown in the parentheses due to breakage.
**Blade inoperable by the time shown in the parentheses due to chipping.

As is obvious from the results shown in Table 6, the coated cermet cutting blades of the present invention, EXc 1 to EXc 12, the substrate of each cutting blade being a cermet which comprises double-structural hard phases wherein the shell portion is discontinuously distributed around the core portion, are provided with much more excellent fracture-resistance as compared with the coated cermet cutting blades for comparison, CEc 1 to CEc 12, the substrate of each cutting blade for comparison being a cermet which comprises double-structural hard phases wherein the shell portion is completely distributed around the core portion, namely, completely surrounding the core portion; and/or single-structural hard phases.

EXAMPLE 4

Another set of the cermet cutting blades EX 11 to EX 16 according to the present invention were manufactured, and these were used as substrates and coated by the methods shown in Table 7 to obtain coated cermet cutting blades of the present invention, EXc 13 to EXc 24, each cutting blade having the coating formulation and the mean layer thickness shown in Table 7. An arc ion plating system, which is a system for physical vapor deposition, or a chemical deposition system was used for coating under the same coating conditions as in Example 3.

For comparison, another set of the cermet cutting blades for comparison, CE 11 to CE 16, were manufactured, and these were subjected to the same procedure as above to manufacture coated cermet cutting blades for comparison, CEc 13 to CEc 24.

On each cermet cutting blade manufactured as described above, the fracture resistance was evaluated by measuring the flank-wear breadth of the cutting edge after wet interrupted-cutting was performed under the following conditions.

Steel material to be cut: a round bar standardized as JIS S20C, DIN CK22, ANSI 1020, which has four flutes provided in the longitudinal direction at regular intervals;

Cutting speed: 400 m/min.;

Feed rate: 0.2 mm/rev.;

Depth of cut: 2 mm; and

Cutting time: 20 min.

The results are shown in Table 7.

TABLE 7

| | | Base | | Formulation of Hard Coating Layers and Mean Thickness Thereof (μm) ←(Lower Layer)(Upper Layer)→ | Coating Method | Flank-Wear Breadth (mm) |
|---|---|---|---|---|---|---|
| Coated Cerment Cutting Blade of the Present Invention | EXc 13 | Coated Cerment Cutting Blade of the Present Invention | EX 11 | TiN[0.5]-Ti(C,N)[2]-TiN[0.5] | PVD | 0.17 |
| | EXc 14 | | EX 12 | (Ti,Al)N[2]-TiN[0.2] | PVD | 0.15 |
| | EXc 15 | | EX 13 | TiN[1]-(Ti,Al)N[4] | PVD | 0.15 |
| | EXc 16 | | EX 14 | TiN[0.5]-(Ti,Al)N[2]-TiN[0.5] | PVD | 0.16 |
| | EXc 17 | | EX 15 | Ti(C,N)[1]-(Ti,Al)N[3] | PVD | 0.18 |
| | EXc 18 | | EX 16 | TiN[0.5]-Ti(C,N)[0.5]-(Ti,Al)N[1]-TiN[0.2] | PVD | 0.20 |
| | EXc 19 | | EX 11 | Ti(C,N)[2]-TiN[0.5] | CVD | 0.12 |
| | EXc 20 | | EX 12 | TiN[0.5]-Ti(C,N)[2]-$Al_2O_3$[1]-TiN[0.5] | CVD | 0.10 |
| | EXc 21 | | EX 13 | Ti(C,N)[3]-Ti(C,O)[0.5]-$Al_2O_3$[3] | CVD | 0.11 |
| | EXc 22 | | EX 14 | TiN[1]-Ti(C,N)[3]-TiN[1.5] | CVD | 0.12 |
| | EXc 23 | | EX 15 | TiN[0.5]-Ti(C,N)[2]-TiC[1]-$Al_2O_3$[2]-TiN[0.5] | CVD | 0.14 |
| | EXc 24 | | EX 16 | TiN[0.5]-TiCN[0.5]-Ti(C,N,O)[0.5]-$Al_2O_3$[5]-TiN[0.5] | CVD | 0.15 |
| Coated Cerment Cutting Blade for Comparison | CEc 13 | Coated Cerment Cutting Blade for Comparison | CE 11 | TiN[0.5]-Ti(C,N)[2]-TiN[0.5] | PVD | *(3 min) |
| | CEc 14 | | CE 12 | (Ti,Al)N[2]-TiN[0.2] | PVD | *(5 min) |
| | CEc 15 | | CE 13 | TiN[1]-(Ti,Al)N[4] | PVD | *(5 min) |
| | CEc 16 | | CE 14 | TiN[0.5]-(Ti,Al)N[2]-TiN[0.5] | PVD | *(5 min) |
| | CEc 17 | | CE 15 | Ti(C,N)[1]-(Ti,Al)N[3] | PVD | *(7 min) |
| | CEc 18 | | CE 16 | TiN[0.5]-Ti(C,N)[0.5]-(Ti,Al)N[1]-TiN[0.2] | PVD | **(10 min) |
| | CEc 19 | | CE 11 | Ti(C,N)[2]-TiN[0.5] | CVD | *(1 min) |
| | CEc 20 | | CE 12 | TiN[0.5]-Ti(C,N)[2]-$Al_2O_3$[1]-TiN[0.5] | CVD | *(1 min) |
| | CEc 21 | | CE 13 | Ti(C,N)[3]-Ti(C,O)[0.5]-$Al_2O_3$[3] | CVD | *(1 min) |
| | CEc 22 | | CE 14 | TiN[1]-Ti(C,N)[3]-TiN[1.5] | CVD | *(3 min) |
| | CEc 23 | | CE 15 | TiN[0.5]-Ti(C,N)[2]-TiC[1]-$Al_2O_3$[2]-TiN[0.5] | CVD | *(2 min) |
| | CEc 24 | | CE 16 | TiN[0.5]-TiCN[0.5]-Ti(C,N,O)[0.5]-$Al_2O_3$[5]-TiN[0.5] | CVD | *(4 min) |

*Blade inoperable by the time shown in the parentheses due to breakage.
**Blase inoperable by the time shown in the parentheses due to chipping.

As is obvious from the results shown in Table 7, the coated cermet cutting blades of the present invention, EXc 13 to EXc 24, the substrate of each cutting blade being a cermet which comprises double-structural hard phases wherein the shell portion is discontinuously distributed around the core portion, are provided with much more excellent fracture-resistance as compared with the coated cermet cutting blades for comparison, CEc 13 to CEc 24, the substrate of each cutting blade for comparison being a cermet which comprises double-structural hard phases wherein the shell portion is completely distributed around the core portion, namely, completely surrounding the core portion; and/or single-structural hard phases.

As described in Examples 1 to 4 above, the cermet cutting blades or the coated cermet cutting blades according to the present invention have excellent fracture-resistance, and therefore, chipping or fracture does not occur at the cutting edges during continuous cutting, in addition, even during interrupted cutting under a severe cutting condition. Accordingly, the cermet cutting blades or the coated cermet cutting blades of the present invention can exhibit excellent cutting performance for a long time, and are advantageous from an industrial view.

The disclosures of Japan priority patent applications HEI 8-266017 and HEI 8-266018, each filed Oct. 7, 1996, and HEI 8-189184, filed Jul. 18, 1996, are hereby incorporated by reference.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. In a cutting blade made of a titanium carbonitride-base cermet comprising:

3 to 20% by weight of a metal binder phase, the principal ingredients of which are Co and/or Ni, 3 to 30% by weight of a single-structural hard phase comprising at least one component selected from the group consisting of carbide, nitride and carbonitride compounds of metal elements belonging to Groups 4*a*, 5*a* and 6*a* of the periodic table and a solid-solution comprising at least two said compounds, and the balance being a double-structural hard phase which comprises a core portion and a shell portion completely surrounding said core portion, wherein said core and shell portions comprise as substituents titanium carbonitride and/or a carbonitride compound of Ti and at least one element M selected from metal elements belonging to Groups 4*a*, 5*a* and 6*a* of the periodic table other than Ti, except that the shell portion must contain a carbonitride compound of at least M, and wherein said shell portion has a lower content of Ti and a higher content of M than those in the core portion, respectively; and incidental impurities, the improvement comprising:

said double-structural hard phase is partly or wholly substituted with a discontinuous double-structural hard phase comprising a core portion and a shell portion, in which the shell portion is discontinuously distributed around the core portion so that the core portion is partially exposed to the metal binder phase, and said discontinuous double-structural hard phase occupies 30 or more area % of the total surface of the cermet in terms of electron-microscopic texture analysis.

2. In a cutting blade made of a titanium carbonitride-base cermet comprising:

3 to 20% by weight of a metal binder phase, the principal ingredients of which are Co and/or Ni, 3 to 30% by weight of a single-structural hard phase comprising at least one component selected from the group consisting of carbide, nitride and carbonitride compounds of metal elements belonging to Groups 4*a*, 5*a* and 6*a* of the periodic table and a solid-solution comprising at least two said compounds, and the balance being a double-structural hard phase which comprises a core portion and a shell portion completely surrounding said core portion, wherein said core and shell portions comprise as substituents titanium carbonitride and/or a carbonitride compound of Ti and at least one element M selected from metal elements belonging to Groups 4*a*, 5*a* and 6*a* of the periodic table other than Ti, except that the shell portion must contain a carbonitride compound of at least M, and wherein said shell portion has a lower content of Ti and a higher content of M than those in the core portion, respectively; and incidental impurities, and said cutting blade having a hardened region in its surface portion, wherein the peak of Vickers hardness higher than the Vickers hardness of an inner portion is present within a range from the top surface of the blade to 50 μm under the top surface, the improvement comprising:

said double-structural hard phase is partly or wholly substituted with a discontinuous double-structural hard phase comprising a core portion and a shell portion in which the shell portion is discontinuously distributed around the core portion so that the core portion is partially exposed to the metal binder phase, and said discontinuous double-structural hard phase occupies 30 or more area % of the total surface of the cermet in terms of electron-microscopic texture analysis.

3. In a cutting blade made of a cermet having a coating thereon, comprising, as the cermet:

3 to 20% by weight of a metal binder phase, the principal ingredients of which are Co and/or Ni, 3 to 30% by weight of a single-structural hard phase comprising at least one component selected from the group consisting of carbide, nitride and carbonitride compounds of metal elements belonging to Groups 4*a*, 5*a* and 6*a* of the periodic table and a solid-solution comprising at least two said compounds, and the balance being a double-structural hard phase which comprises a core portion and a shell portion completely surrounding said core portion, wherein said core and shell portions comprise as substituents titanium carbonitride and/or a carbonitride compound of Ti and at least one element M selected from metal elements belonging to Groups 4*a*, 5*a* and 6*a* of the periodic table other than Ti, except that the shell portion must contain a carbonitride compound of at least M, and wherein said shell portion has a lower content of Ti and a higher content of M than those in the core portion, respectively; and incidental impurities, and said coating comprises at least one compound selected from titanium carbide, titanium nitride, titanium carbonitride, titanium carbonate-nitride compound, (Ti, Al)N, and aluminum oxide, in a thickness of 0.5 to 20 μm, the improvement comprising:

said double-structural hard phase is partly or wholly substituted with a discontinuous double-structural hard phase ocomprising a core portion and a shell portion, in which the shell portion is discontinuously distributed around the core portion so that the core portion is partially exposed to the metal binder phase, and said discontinuous double-structural hard phase occupies 30 or more area % of the total surface of the cermet in terms of electron-microscopic texture analysis.

4. In a cutting blade made of a cermet having a coating thereon, said cermet comprising:

3 to 20% by weight of a metal binder phase, the principal ingredients of which are Co and/or Ni, 3 to 30% by weight of a single-structural hard phase comprising at least one component selected from the group consisting of carbide, nitride and carbonitride compounds of metal elements belonging to Groups 4a, 5a and 6a of the periodic table and a solid-solution comprising at least two said compounds, and the balance being a double-structural hard phase which comprises a core portion and a shell portion completely surrounding said core portion, wherein said core and shell portions comprise as substituents titanium carbonitride and/or a carbonitride compound of Ti and at least one element M selected from metal elements belonging to Groups 4a, 5a and 6a of the periodic table other than Ti, except that the shell portion must contain a carbonitride compound of at least M, and wherein said shell portion has a lower content of Ti and a higher content of M than those in the core portion, respectively; and incidental impurities, said cutting blade having a hardened region in its surface portion, wherein the peak of Vickers hardness higher than the Vickers hardness of an inner portion is present within a range from the top surface of the blade to 50 μm under the top surface, and said coating comprising at least one compound selected from titanium carbide, titanium nitride, titanium carbonitride, titanium carbonate-nitride compound, (Ti, Al)N, and aluminum oxide, in a thickness of 0.5 to 20 μm, the improvement comprising:

said double-structural hard phase is partly or wholly substituted with a discontinuous double-structural hard phase ocomprising a core portion and a shell portion, in which the shell portion is discontinuously distributed around the core portion so that the core portion is partially exposed to the metal binder phase, and said discontinuous double-structural hard phase occupies 30 or more area % of the total surface of the cermet in terms of electron-microscopic texture analysis.

5. The cutting blade claimed in claim 1, wherein the mean grain sizes of the hard phases of the cermet are 0.1 to 1.5 μm, respectively.

6. The cutting blade claimed in claim 2, wherein the mean grain sizes of the hard phases of the cermet are 0.1 to 1.5 μm, respectively.

7. The cutting blade claimed in claim 3, wherein the mean grain sizes of the hard phases of the cermet are 0.1 to 1.5 μm, respectively.

8. The cutting blade claimed in claim 4, wherein the mean grain sizes of the hard phases of the cermet are 0.1 to 1.5 μm, respectively.

9. The cutting blade claimed in claim 5, wherein the mean grain sizes of the hard phases of the cermet are 0.5 to 1.2 μm, respectively.

10. The cutting blade claimed in claim 6, wherein the mean grain sizes of the hard phases of the cermet are 0.5 to 1.2 μm, respectively.

11. The cutting blade claimed in claim 7, wherein the mean grain sizes of the hard phases of the cermet are 0.5 to 1.2 μm, respectively.

12. The cutting blade claimed in claim 8, wherein the mean grain sizes of the hard phases of the cermet are 0.5 to 1.2 μm, respectively.

13. The cutting blade claimed in claim 3, wherein the coating contains a (Ti,Al)N coating layer having a thickness of 0.5 to 5 μm.

14. The cutting blade claimed in claim 4, wherein the coating contains a (Ti,Al)N coating layer having a thickness of 0.5 to 5 μm.

15. The cutting blade claimed in claim 3, wherein the coating contains a TiCN coating layer in a thickness of 0.5 to 5 μm having a longitudinal growth crystal structure in which crystal grains are elongated along a direction perpendicular to the surface of said cermet.

16. The cutting blade claimed in claim 4, wherein the coating contains a TiCN coating layer in a thickness of 0.5 to 5 μm having a longitudinal growth crystal structure in which crystal grains are elongated along a direction perpendicular to the surface of said cermet.

* * * * *